US008418320B2

(12) United States Patent
Halbritter

(10) Patent No.: US 8,418,320 B2
(45) Date of Patent: Apr. 16, 2013

(54) HINGE FOR A SWINGABLE BODY PART OF A VEHICLE

(75) Inventor: Johann Halbritter, Wettstetten (DE)

(73) Assignee: Audi AG, Ingolstadt (DE)

( * ) Notice: Subject to any disclaimer, the term of this patent is extended or adjusted under 35 U.S.C. 154(b) by 0 days.

(21) Appl. No.: 13/222,611

(22) Filed: Aug. 31, 2011

(65) Prior Publication Data

US 2012/0047687 A1 Mar. 1, 2012

(30) Foreign Application Priority Data

Sep. 1, 2010 (DE) ..... 10 2010 035 985

(51) Int. Cl.
*E05D 5/00* (2006.01)
*E05D 11/00* (2006.01)

(52) U.S. Cl.
USPC ..... 16/382; 16/387; 16/223; 16/222

(58) Field of Classification Search ..... 16/222, 16/239, 86 C, 326, 363, 371, 374, 375, 382, 16/387; 296/146.11, 146.12, 187.03, 187.04; 180/69.2, 69.21, 271, 274, 289
See application file for complete search history.

(56) References Cited

U.S. PATENT DOCUMENTS

| | | | | | |
|---|---|---|---|---|---|
| 2,122,007 | A * | 6/1938 | Kearney | 16/252 |
| 2,147,133 | A * | 2/1939 | Ackerman | 49/398 |
| 2,228,876 | A * | 1/1941 | Howe | 16/379 |
| 4,305,614 | A * | 12/1981 | Holka et al. | 296/37.16 |
| 5,038,436 | A * | 8/1991 | Ihrke | 16/249 |
| 5,095,582 | A * | 3/1992 | Ohlsson | 16/235 |
| 6,543,086 | B2 * | 4/2003 | Bjureblad et al. | 16/222 |
| 2003/0010552 | A1 * | 1/2003 | Kim | 180/69.21 |
| 2004/0189053 | A1 * | 9/2004 | Zummallen et al. | 296/202 |
| 2005/0212325 | A1 * | 9/2005 | Rangnekar et al. | 296/146.12 |
| 2006/0096062 | A1 * | 5/2006 | Woolcock | 16/238 |
| 2009/0078487 | A1 * | 3/2009 | Borg et al. | 180/274 |

FOREIGN PATENT DOCUMENTS

| | | | | |
|---|---|---|---|---|
| DE | 102 27 706 | C1 | | 5/2003 |
| DE | 200 23 228 | U1 | | 7/2003 |
| DE | 10 2009 058 956 | | | 7/2010 |
| GB | 2144797 | A | * | 3/1985 |
| JP | 09132033 | A | * | 5/1997 |
| JP | 11291948 | A | * | 10/1999 |
| JP | 2008265693 | A | * | 11/2008 |

* cited by examiner

*Primary Examiner* — Chuck Y. Mah
(74) *Attorney, Agent, or Firm* — Henry M. Feiereisen LLC

(57) ABSTRACT

A hinge for a swingable body part of a vehicle includes a hinge element having an attachment part, and at least one connection element for securing the attachment part of the hinge element to a body part or vehicle shell structure. The attachment part of the hinge element is constructed to move in relation to the body part and/or vehicle shell structure without disengagement when a load limit is exceeded.

9 Claims, 3 Drawing Sheets

HINGE FOR A SWINGABLE BODY PART OF A VEHICLE

CROSS-REFERENCES TO RELATED APPLICATIONS

This application claims the priority of German Patent Application, Serial No. 10 2010 035 985.8, filed Sep. 1, 2010, pursuant to 35 U.S.C. 119(a)-(d), the content of which is incorporated herein by reference in its entirety as if fully set forth herein.

BACKGROUND OF THE INVENTION

The present invention relates to a hinge for a swingable body part, such as hatch or a door, of a vehicle.

The following discussion of related art is provided to assist the reader in understanding the advantages of the invention, and is not to be construed as an admission that this related art is prior art to this invention.

Hinges are used in vehicle construction to swingably arrange body parts at access openings of the vehicle shell structure. When the vehicle, in particular the body part, undergoes deformation as a consequence of an accident, the hinge is exposed to substantial forces which could lead to a breakdown of the hinge and thus to a disengagement of the body part from the vehicle shell structure. Reinforcing the hinge is not an option because of the added weight that accompanies the increase in material use.

It would be desirable and advantageous to provide an improved hinge for a swingable body part of a vehicle to obviate prior art shortcomings while being simple in structure and inexpensive to produce and reliable in operation.

SUMMARY OF THE INVENTION

According to one aspect of the present invention, a hinge for a swingable body part of a vehicle includes a hinge element having an attachment part, and at least one connection element for securing the attachment part of the hinge element to a body part or vehicle shell structure, wherein the attachment part of the hinge element is constructed to move in relation to the body part and/or vehicle shell structure without disengagement when a load limit is exceeded.

The present invention resolves prior art shortcomings by allowing the attachment part of a hinge to move in relation to the structure to which the hinge is mounted without disengagement and thereby be able to compensate even substantial deformations. As the attachment part is able to move, the hinge is exposed to lesser forces and thus can be constructed lightweight while still being sturdy enough to prevent breakdown. By eliminating the need for additional heavy structures, the hinge can not only be constructed lightweight but produced in a cost-efficient manner. Access openings to the interior of the body are provided with swingable body parts to enable them to be opened or closed. In the event of an accident and the resultant generation of forces, the hinges may not disintegrate in order to avoid inadvertent exposure of the access opening. When the load limit is exceeded as a result of excessive deformation on the vehicle shell structure and/or body part, the connection element deflects spontaneously the excess force by providing sufficient space for the deformation and maintaining the connection of the hinge with the vehicle shell structure or the body part at the same time. The term "vehicle shell structure" relates to any permanently fixed component of the vehicle body.

According to another advantageous feature of the present invention, the at least one connection element can be secured in a sleeve which is axially movable relative to the body part and/or vehicle shell structure. The connection part is fixed in place within the sleeve. The sleeve, in turn, may move in relation to the body part and/or vehicle shell structure, when the load limit is exceeded, without being completely detached there from.

According to another advantageous feature of the present invention, a nut can be secured to the body part and/or vehicle shell structure, with the sleeve being guided in the nut. The nut reinforces the body part and/or vehicle shell structure in the region of the attachment upon the hinge by allowing a removal of the force across a larger area.

According to another advantageous feature of the present invention, the sleeve can be connected to the body part and/or vehicle shell structure or the nut by interference fit, with the interference fit being rendered ineffective when the load limit is exceeded. An example of an interference fit includes a press-fit which disengages, when the load limit is exceeded. As an alternative, a safety bolt or the like may be provided which shears off.

According to another advantageous feature of the present invention, the sleeve may have an end stop to impact the body part and/or vehicle shell structure or the nut, when being displaced by a maximum distance. The end stop also prevents a detachment of the hinge from the body part and/or vehicle shell structure after the sleeve has moved the maximum distance.

According to another advantageous feature of the present invention, the attachment part can bear upon the body part and/or vehicle shell structure, with the sleeve extending away from the hinge into the body part and/or vehicle shell structure. The sleeve and the nut are thus positioned on the side of the body part and/or vehicle shell structure facing away from the hinge, whereas the connection element is arranged to the side of the hinge.

According to another advantageous feature of the present invention, the hinge element can have a joint part for articulation to a further hinge element, with the joint part extending at an angle to the attachment part.

According to another advantageous feature of the present invention, the body part may be configured as a hatch or a door. Examples of a hatch involve a front hood or a tailgate. Doors are to be understood as doors on the side of the vehicle.

According to another aspect of the present invention, a vehicle includes at least one body part, and at least two hinges swingably securing the body part to a vehicle shell structure, each of the hinges including a hinge element having an attachment part, and at least one connection element for securing the attachment part of the hinge element to a body part or vehicle shell structure, wherein the attachment part of the hinge element is constructed to move in relation to the body part and/or vehicle shell structure without detachment, when a load limit is exceeded.

The presence of two hinges in parallel disposition increases stability and safety of the body part. When the body part involves a door, the door is suitably mounted to a body pillar of the vehicle shell structure.

BRIEF DESCRIPTION OF THE DRAWING

Other features and advantages of the present invention will be more readily apparent upon reading the following description of currently preferred exemplified embodiments of the invention with reference to the accompanying drawing, in which.

DETAILED DESCRIPTION OF PREFERRED EMBODIMENTS

Figure 1:
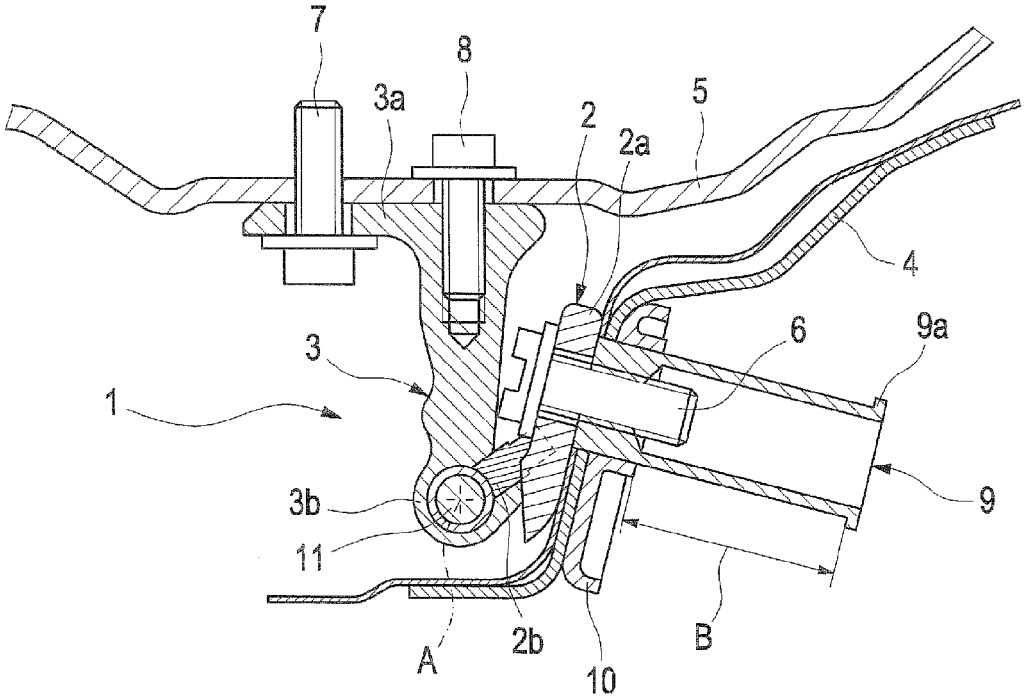
FIG. 1 is a sectional view of one embodiment of a hinge according to the present invention in a state before a load limit is exceeded.

Throughout all the figures, same or corresponding elements may generally be indicated by same reference numerals. These depicted embodiments are to be understood as illustrative of the invention and not as limiting in any way. It should also be understood that the figures are not necessarily to scale and that the embodiments are sometimes illustrated by graphic symbols, phantom lines, diagrammatic representations and fragmentary views. In certain instances, details which are not necessary for an understanding of the present invention or which render other details difficult to perceive may have been omitted.

Figure 2:
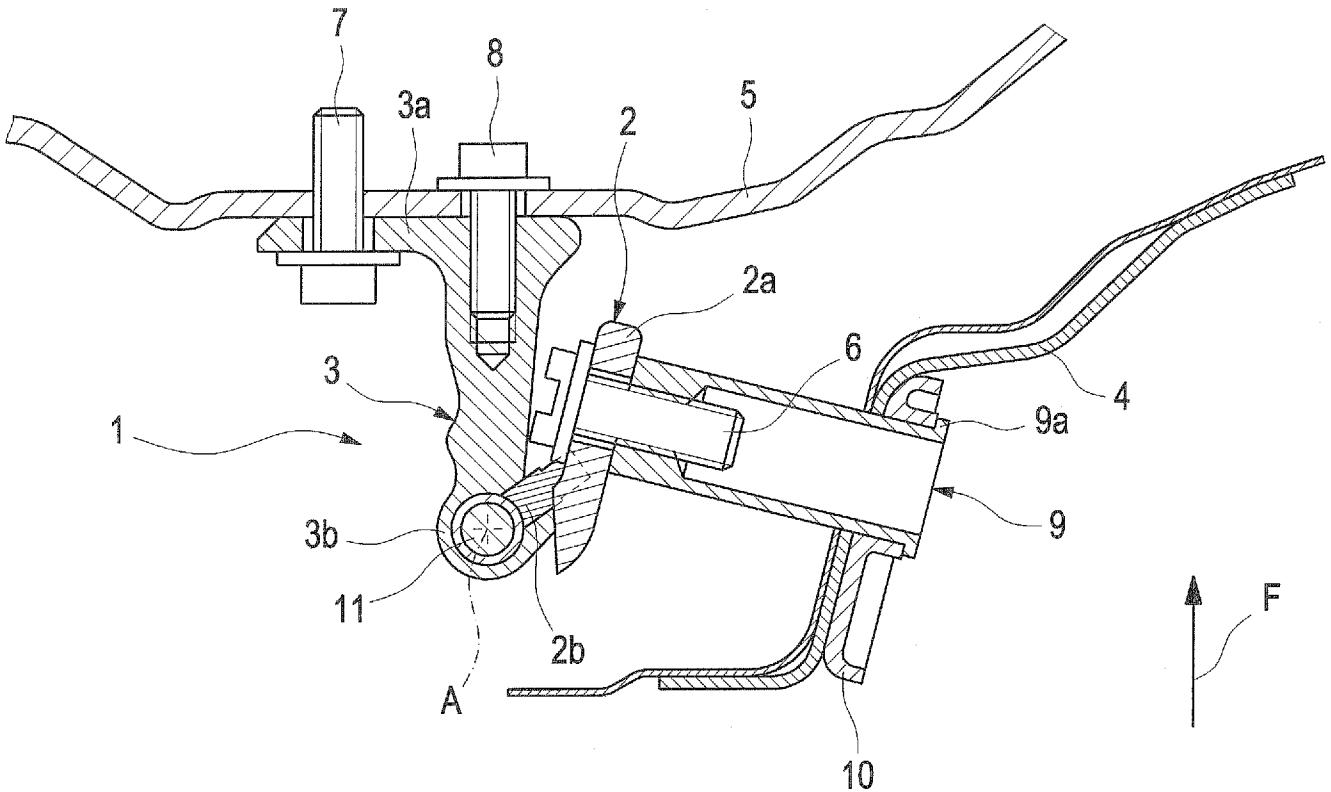
FIG. 2 is a sectional view of the hinge in a state after a load limit is exceeded.

Turning now to the drawing, and in particular to FIG. 1, there is shown a sectional view of one embodiment of a hinge according to the present invention, generally designated by reference numeral 1 for a swingable body part 4 of a vehicle. FIG. 1 shows the hinge 1 in normal state in which the load limit has not yet been exceeded. FIG. 2 shows the hinge 1 after the load limit has been exceeded and the body part 4 has been deformed as a result of a force F acting on the body part 4. The hinge 1 includes two hinge elements 2, 3 which are articulated to one another. Each of the hinge elements 2, 3 includes an attachment part 2*a*, 3*a*, and a joint part 2*b*, 3*b*, arranged at an angle to the attachment part 2*a*, 3*a*. The joint parts 2*b*, 3*b* are connected to one another by a common hinge bolt 11 such that the hinge elements 2, 3 are swingable relative to another about a pivot axis A. The attachment part 2*a* of the hinge element 2 is mounted by a first connection element 6 to the body part 4, e.g. an door inner molding. Arranged on the side of the body part 4 that is distal to the hinge 1 is a nut 10 in which a sleeve 9 is supported for axial displacement. The first connection element 6 is configured as a bolt and threadably engages the sleeve 9 from the side of the body part 4.

As can be seen from FIG. 1, the attachment part 2*a* of the hinge element 2 bears upon the body part 4. The sleeve 9 is pressed into the nut 10 such that the nut 10 and the sleeve 9 are immobile relative to one another under normal use of the body part 4. When, as shown in FIG. 2, a force F acts from outside on the body part 4 to cause a deformation of the body part 4, the press-fit between sleeve 9 and nut 10 is released after the load limit has been exceeded. The sleeve 9 is thus able to move conjointly with the bolt 6 in relation to the nut 10 until an end stop 9*a* of the sleeve 9 impacts the nut 10 after the sleeve 9 has moved the maximum displacement distance B. The other hinge element 3 is securely screwed permanently to a vehicle shell structure 5 by two connection elements 7, 8 which are configured as bolts.

Figure 3:
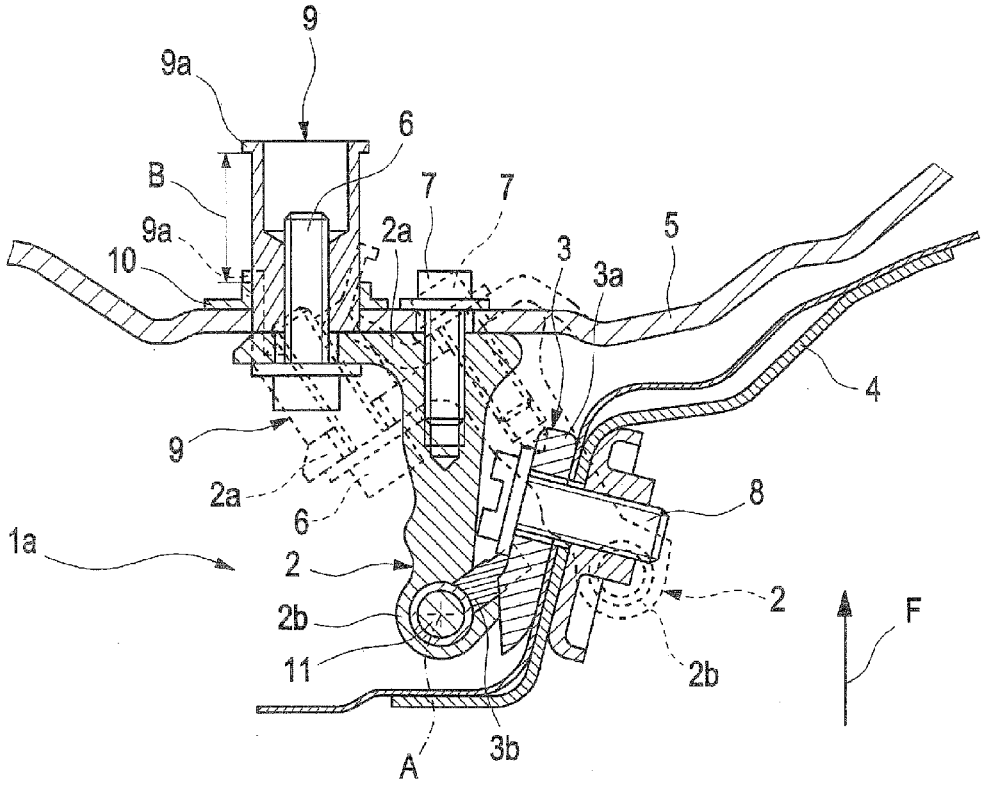
FIG. 3 is a sectional view of another embodiment of a hinge according to the present invention in a state before and after a load limit is exceeded.
Figure 4:
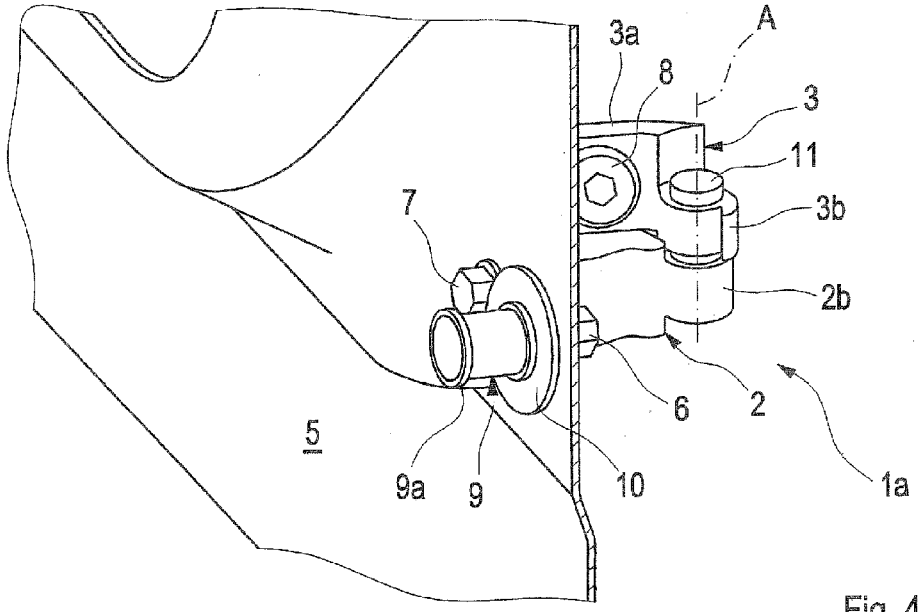
FIG. 4 is a view of the hinge of FIG. 3 before a load limit is exceeded.

Referring now to FIG. 3, there is shown a sectional view of another embodiment of a hinge according to the present invention, generally designated by reference numeral 1*a* for a swingable body part 4 of a vehicle. Parts corresponding with those in FIG. 1 are denoted by identical reference numerals. FIG. 3 shows by way of solid lines the normal state in which the load limit has not yet been exceeded. The broken line shows the hinge 1*a* after the load limit has been exceeded as a result of a force F acting on the body part 4 and causing a deformation of the body part 4. The hinge 1*a* includes two hinge elements 2, 3 articulated to one another, with each hinge element 2, 3 having an attachment part 2*a*, 3*a* and a joint part 3*a*, 3*b* angled thereto. The joint parts 2*b*, 3*b* are connected to one another by a common hinge bolt 11 such that the hinge elements 2, 3 are swingable relative to another about a pivot axis A. The attachment part 2*a* of the hinge element 2 is mounted by a first connection element 6 and a second connection element 7 to a vehicle shell structure 5, with the first connection element 6 being positioned further away from the pivot axis A than the second connection element 7. Arranged on the side of the vehicle shell structure 5 which is distal to the hinge 1 is a nut 10 in which a sleeve 9 is supported for axial displacement, as shown in FIG. 4. Threadably engaged from the side of the hinge 1 is the first connection element 6 which is configured as bolt. The second connection element 7 which is also configured as a bolt is threadably engaged from the opposite direction directly into the attachment part 2*a* of the hinge element 2. In normal state, shown in solid lines, the attachment part 2*a* of the hinge element 2 bears upon the vehicle shell structure 5. The sleeve 9 is pressed into the nut 10 such that the nut 10 and the sleeve 9 are immobile relative to one another under normal use of the body part 4. When, as shown by broken line, a force F acts from outside on the body part 4 to cause a deformation of the body part 4, the press-fit between sleeve 9 and nut 10 is released after the load limit has been exceeded. The sleeve 9 is thus able to move conjointly with the bolt 6 in relation to the nut 10 until an end stop 9*a* of the sleeve 9 impacts the nut 10 after the sleeve 9 has moved a maximum displacement distance B. As the second connection element 7 continues to press the attachment part 2*a* against the vehicle shell structure 5, the attachment part 2*a* disengages from the vehicle shell structure 5 only in the region of the first connection element 6. As a result, the sleeve 9 and the vehicle shell structure 5 undergo only a non-critical deformation, while the hinge 1*a* remains intact. The further hinge element 3 is securely screwed permanently to the body part 4 by a third connection element 8 which is configured as bolt.

While the invention has been illustrated and described in connection with currently preferred embodiments shown and described in detail, it is not intended to be limited to the details shown since various modifications and structural changes may be made without departing in any way from the spirit and scope of the present invention. The embodiments were chosen and described in order to explain the principles of the invention and practical application to thereby enable a person skilled in the art to best utilize the invention and various embodiments with various modifications as are suited to the particular use contemplated.

What is claimed as new and desired to be protected by Letters Patent is set forth in the appended claims and includes equivalents of the elements recited therein:

1. A hinge, said hinge comprising:

a hinge element having an attachment part and constructed for articulation to another hinge element;

at least one connection element for securing the attachment part of the hinge element to a member selected from the group consisting of body part and vehicle shell structure, said attachment part of the hinge element being constructed to move in relation to the member without disengagement when a load limit is exceeded as a result of a deformation on the member; and a sleeve defined by an axis and movable in a direction of the axis relative to the member, said at least one connection element being secured in the sleeve.

2. The hinge of claim 1, further comprising a stationary nut, said sleeve being received in the nut.

3. The hinge of claim 2, wherein the sleeve is connected to the nut by interference fit, said interference fit being rendered ineffective when the load limit is exceeded so as to allow movement of the sleeve in relation to the nut.

4. The hinge of claim 3, wherein the sleeve has an end stop which impacts the member or the nut, when the sleeve moves in relation to the nut by a maximum distance.

5. The hinge of claim 1, wherein the sleeve extends in a direction of the axis away from the attachment part of the hinge element.

6. The hinge of claim 1, wherein the hinge element has a joint part for articulation to the other hinge element, said joint part extending at an angle to the attachment part.

7. The hinge of claim 1, wherein the body part is configured as a hatch or a door.

8. A vehicle, comprising:

at least one body part; and at least two hinges swingably securing the body part to a vehicle shell structure, each of the hinges including a hinge element having an attachment part and constructed for articulation to another hinge element, at least one connection element for securing the attachment part of the hinge element to a member selected from the group consisting of body part and vehicle shell structure, said attachment part of first hinge element being constructed to move in relation to the member without disengagement when a load limit is exceeded as a result of a deformation on the member, and a sleeve defined by an axis and movable in a direction of the axis relative to the member, said at least one connection element being secured in the sleeve.

9. The vehicle of claim 8, wherein the hinges extend in parallel relationship.

* * * * *